United States Patent [19]

Engle et al.

[11] 4,403,488

[45] Sep. 13, 1983

[54] IN-PURSE KEY HOLDER

[76] Inventors: Angeline V. Engle; Richard A. Engle, both of 7594 E. 12 Mile Rd., Warren, Mich. 48092

[21] Appl. No.: 263,707

[22] Filed: May 14, 1981

[51] Int. Cl.[3] ..... A47G 29/10

[52] U.S. Cl. ..... 70/458

[58] Field of Search ..... 70/456–459; 24/3 K, 138 R, 137 R; 150/34, 40; D3/61, 62

[56] References Cited

U.S. PATENT DOCUMENTS 2,117,989 5/1938 Ryan ..... 150/34

FOREIGN PATENT DOCUMENTS 116205 5/1941 Australia ..... 24/138 R

*Primary Examiner*—Robert L. Wolfe

*Attorney, Agent, or Firm*—Gerald R. Hershberger

[57] ABSTRACT

A device for holding a key ring or the like in a handbag which has an elongated one-piece plastic body. The body includes a bill-like portion having a mouth-like opening defining two oppositely disposed jaws arranged and adapted to slip over and resiliently grip an open edged interior compartment wall in the handbag, such as a center compartment wall. An inclined shoulder portion holds the jaws cantilevered in clamping position on the wall. A necked-down substantially elongated key ring holder portion is connected in off-centered relationship to said shoulder oppositely to said mouth, which necked-down portion or protrusion forms a ledge with the shoulder behind the neck for securing and suspending the key ring on the compartment wall where it is eminently visible and readily available.

1 Claim, 5 Drawing Figures

IN-PURSE KEY HOLDER

BACKGROUND OF THE INVENTION

1. Field of the Invention

This invention relates to in-purse key holder and particularly to a key holder mounted on an interior compartmental wall of a ladies handbag.

2. Description of the Prior Art

The difficulty in locating keys and similar objects in a woman's handbag, when they are desired for use, is well known, and many devices have been proposed and patented in an effort to deal efficiently with the problem. However, the devices of the prior art leave much to be desired with respect to ease of operation and methods of attachment thereof to the handbag or purse. Many of such devices requiring complicated fasteners to secure the key holder to the purse, and complicated means for holding the key ring or chain to the holder.

It is important that the key holder be made readily available, and easily placed in position for use in the handbag, and the devices heretofore disclosed do not provide for such characteristics.

SUMMARY OF THE INVENTION

Accordingly, the problems and difficulties that are encountered in the prior art using conventional in-purse key holders are obviated by the present invention, in which is provided an in-purse holder for keys and the like which is readily attached to a compartmentalized wall of the purse, and to which holder the key ring or other key fastening means may be readily attached or removed.

It is another object of the present invention to provide a bifurcated key holder that will fasten readily to a compartment wall of the purse.

It is another object of this the present invention to provide a bifurcated key holder that will fasten to a compartmentalized wall having hook means operable, in conjunction with a handle or neck portion, to secure the key ring inside a purse.

These and other objects and advantages of the invention will become subsequently apparent from the details of construction and operation of the invention as more fully described and claimed below.

BRIEF DESCRIPTION OF THE DRAWING

The present invention may be better understood and numerous other features and advantages thereof will become apparent to those skilled in the art by reference to the accompanying drawing wherein like reference numerals refer to like elements in the various figures in which.

DESCRIPTION OF THE PREFERRED EMBODIMENT

Figure 1:
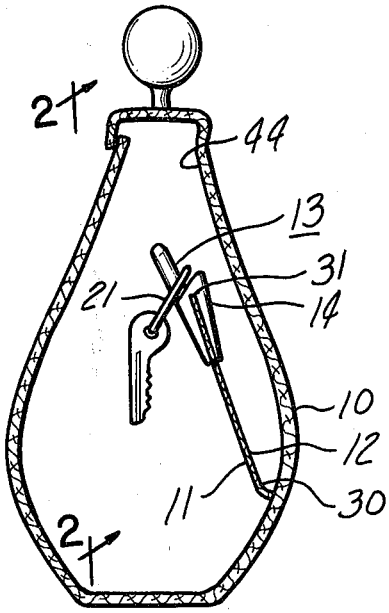
FIG. 1 is a partially sectional view of the present invention shown attached in the approved manner to the compartment of a purse with a key ring and holder mounted thereon.

Referring now more particularly to FIG. 1 of the drawing, a woman's handbag 10 of conventional construction is illustrated as having generally vertical walls 11 and 12 spaced closely together to define a partition 30 having a top edge 31 over which is mounted a key ring or chain holder 13 according to the instant invention.

Figure 5:
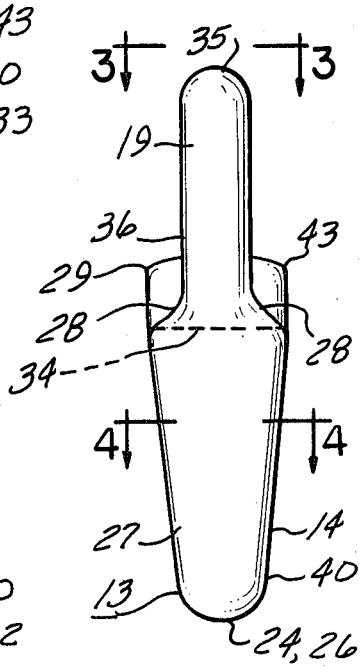
FIG. 5 is an elevational view of the device taken along line 5—5 of FIG. 2.

Holder 13 comprises a one-piece body about 3/12 inches long, constructed of relatively hard resilient plastic having walls defining an elongated generally rectangularly outlined wide bill-like portion 14, having a length of about 2/3 of the body length as seen in FIG. 5, said bill portion having a forward generally flat wall 22, a rear wall 42, a right side wall 27, and a left side wall 40. A deep, substantially straight mouth-like opening or slit 15, bifurcating the bill portion edgewise from the lower ends 24 and 26 upwardly nearly the full length of the bill portion through the right side wall and through the left side wall to form a forward, vertical, forward jaw portion 16 and a rear jaw portion 17. The width of said mouth slit being so arranged and adapted that forward jaw inner wall 32 and rearward jaw inner wall 33 slide over and resiliently grip said walls of said partition adjacent said edge with sufficient pressure to prevent said jaws from slipping from the partition by themselves.

As shown in FIG. 1, the holder 13 is supported vertically in the handbag adjacent inner handbag wall 44. The jaws are supported fixedly in cantilevered fashion adjacent inner radiused corner 34 of the mouth or slit by walls defining an inclined shoulder 18, having a width about 3/16 of the body length which shoulder holds said jaws together and imparts a spring-like effect thereto. Said slit is nearly closed at the lower end and adapted to spring open at least 1/16 to 3/32 inches at the lower ends 24 and 26 of said jaws. The slit tapers from its lower end width to between 1/16 and 3/32 inches wide adjacent said inside corner or intersection of said inner walls and said shoulder.

An elongated, annular, substantially cylindrical necked-down protrusion, portion 19, about ¼ inches in diameter has a free end 35 and a fixed end 36 connected by the fixed end integrally to said shoulder oppositely to said jaws at the juncture 41 of the shoulder and said jaws, and is offset forwardly on the shoulder upper wall 20 to define an upwardly inclined hook-like support ledge or wall portion 38 for securing a key ring or chain 21 or the like between said neck portion and said ledge portion.

Figure 2:
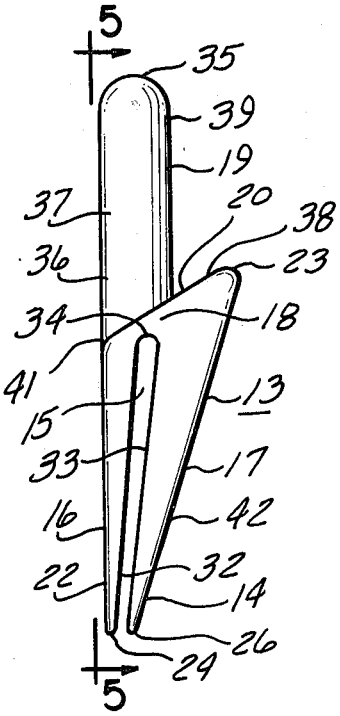
FIG. 2 is an end view of the preferred version of my key holder with the key ring omitted taken along line 2—2 of FIG. 1.

As shown in FIG. 2, to obtain the ledge 38, the forward tangent edge 37 of the neck portion is made flush, substantially straight and aligned linearly and vertically with wall 22, leaving the greater support portion 38 of the ledge slanting upwardly from the intersection 41 of face 37 and rear wall 42 between the upper tip 23 of the ledge and rearward tangent surface 39 of said neck to provide a substantially large rest area with respect to the size of the key ring or holder 21.

Figure 3:
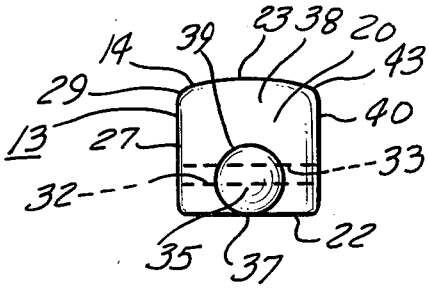
FIG. 3 is a plan view of my key holder-finder taken along line 3—3 of FIG. 2.
Figure 4:
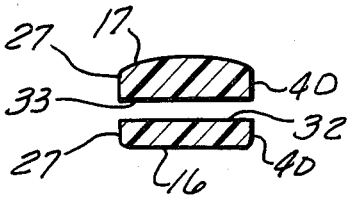
FIG. 4 is a sectional view of the present invention taken along line 4—4 of FIG. 5.

As shown in FIG. 2 and FIG. 5, the wider ledge area is formed from the body by giving a substantially concave wedge effect to the rearward jaw wall 17 starting from the comparatively thin section at its free end 26 in a forwardly depending arc extending upwardly and rearwardly to tip corner 23. The distance across the shoulder from intersection 41 to tip 23 is about 5/8 inches measured horizontally as shown in FIGS. 2, 3 and 4.

As shown in FIG. 2, the forward jaw is generally thin-sectioned horizontally, vertically flat and of generally constant thickness from its free end 24 to immediately adjacent its junction with the shoulder, the inner corner, and neck portion.

Each jaw is about 1/16 inches thick at its lower end. The front jaw is about 3/32 inches thick at its upper fixed end, The width of each jaw is about ½ inch adjacent their lower ends.

The width of the shoulder, as shown in FIG. 5, is about 5/8 inches, which extends the shoulder a substantial distance on each side 29 and 43 of the neck portion.

The rearwardly slanted wall of the rear jaw, that is, tapering from a thin section at its lower end, to a thicker section at its upper end, to provide for resilient action at the bottom end.

The front jaw is also relatively thin for allowing resilient action along its entire length. The thinness of the lower jaw ends also provide for entry of the jaws over partitions in small spaces or pockets in the handbag.

The lower ends of the jaws are preferrably rounded off from the inner slit walls to the outside jaw walls to facilitate entry of the partition into the mouth or slit.

The ends 24 and 26 of said jaws are preferrably reduced or rounded off to blend into the sides 27 and 40 of the bill 14, and taper gradually from said ends outwardly to said shoulder extremities 29 and 43. The juncture of the neck portion with the ledge portion is preferrably blended in with smooth contoured valleys 28. Said shoulder extremities are preferrably also rounded.

The invention is preferrably manufactured from a resilient, tough, plastic that will hold its shape and have sufficient resiliency and spring in said jaws to firmly grip the sides or said walls of the partition securely.

It will thus be seen that the objects hereinbefore set forth may be readily and efficiently obtained, and since certain changes may be made in the above device and different embodiments of the invention could be made without departing from the scope thereof, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention what I claim as new and desire to secure by Letters Patent is:

1. A finder-holder for securing a key ring or the like on a compartment wall of a purse where it is readily accessible, comprising;

an elongated holder body constructed of resilient plastic material, said body having a generally rectangularly outlined bill-like portion extending from the lower ends upwardly about ⅔ the length of the body, including a vertical front wall, an upwardly and rearwardly inclined rear wall, right and left side walls substantially lessor in thickness than the width of front and rear walls, an upwardly and rearwardly slanted substantially flat shoulder portion connecting said walls at their upper ends, a deep straight mouth-like slit vertically bifurcating said bill-like portion edgewise almost the full length thereof to a point adjacent said shoulder nearer to the forward wall than the rearward wall, thereby separating said bill portion into oppositely disposed resilient blade-like jaws including a forwardly disposed jaw portion and a rearwardly disposed jaw portion adapted to resiliently grip the compartment wall, the thickness of the blades being smallest at their free ends, and tapering gradually thicker toward the shoulder, the rearward blade being substantially larger than the width of the free end where it joins the shoulder, and an elongated, annular, necked-down, generally cylindrical protrusion connected integrally in off-centered relationship to the face of said shoulder, the thickness of the protrusion at its juncture with the shoulder being substantially less than the depth of the shoulder, with the protrusion extended oppositely to the slit about ⅓ the length of the body with the front wall of said protrusion positioned in line with and substantially flush with the body front wall, the relative size of the shoulder and protrusion being arranged and adapted to leave a generally upwardly slanted ledge portion having a depth of sufficient size to hold a key ring thereon between the partition and the inside wall of the bag without same slipping down the holder body.

* * * * *